US005117598A

United States Patent [19]

Livingston et al.

[11] Patent Number: 5,117,598

[45] Date of Patent: Jun. 2, 1992

[54] MOLDING STRIPS FOR MOUNTING A FLEXIBLE COVERING ONTO A SUPPORT SURFACE

[76] Inventors: Bryan K. Livingston, 804 S. Ivy St., Arlington, Va. 22204; Douglas M. Hopkins, 7412 Floyd Ave., Springfield, Va. 22150

[21] Appl. No.: 660,232

[22] Filed: Feb. 25, 1991

Related U.S. Application Data

[63] Continuation of Ser. No. 507,873, Apr. 12, 1990, abandoned.

[51] Int. Cl.[5] ..... E04B 1/00

[52] U.S. Cl. ..... 52/222; 52/273; 24/562

[58] Field of Search ..... 52/63, 222, 203, 202, 52/273; 24/457, 545, 555, 556, 562

[56] References Cited

U.S. PATENT DOCUMENTS

| | | | |
|---|---|---|---|
| 3,303,626 | 2/1967 | Brigham | 52/475 |
| 3,513,613 | 5/1970 | Jones et al. | 52/222 |
| 3,857,216 | 12/1974 | Sherman | 52/489 |
| 4,018,260 | 4/1977 | Baslow . | |
| 4,053,008 | 10/1977 | Baslow . | |
| 4,151,762 | 5/1979 | Baslow . | |
| 4,161,977 | 7/1979 | Baslow . | |
| 4,189,880 | 2/1980 | Ballin | 52/202 |
| 4,197,686 | 4/1980 | Baslow . | |
| 4,333,284 | 6/1982 | Meadows | 52/222 |
| 4,441,290 | 4/1984 | Abell | 52/202 |
| 4,590,727 | 5/1986 | Ghahremani et al. | 52/222 |
| 4,625,490 | 12/1986 | Baslow . | |
| 4,631,882 | 12/1986 | Sease . | |
| 4,731,960 | 3/1988 | Sease . | |
| 4,788,806 | 12/1988 | Sease . | |

FOREIGN PATENT DOCUMENTS

| | | | |
|---|---|---|---|
| 2021074 | 11/1970 | Fed. Rep. of Germany . | |
| 389873 | 7/1965 | Switzerland | 52/222 |
| 2051914 | 1/1981 | United Kingdom . | |

*Primary Examiner*—Michael Safavi

*Attorney, Agent, or Firm*—Wenderoth, Lind & Ponack

[57] ABSTRACT

Molding strips are provided for use in frame assemblies for supporting and securing fabric or material sheets on substrates such as walls for decorative and acoustic purposes. An outside corner molding strip is provided, as well as molding strips for use as panel edges. Each panel edge molding strip has an elongated base portion having a back side to be disposed against a surface to which the base portion is to be attached. First and second gripper walls extend substantially perpendicularly from the front side of the base portion. These walls define a space therebetween for receiving fabric material therein. The first and second gripper walls have respective confronting portions having a gripping arrangement therebetween. A fabric material is stuffed between the confronting portions and gripped therebetween, the fabric being accumulated in the space between the gripper walls. In a particularly advantageous feature of the present invention, the distance in a direction perpendicular to the base portion from the back side of the base portion to the distal end of the first gripper wall portion is substantially equal to the distance in a direction substantially parallel to the base portion from a first side edge of the base portion to a line extending substantially centrally between the confronting portions of the first and second gripper walls and substantially perpendicular to the base portion. A one inch height for the molding strips allows a panel absorber material of one inch thickness to be used, effective in absorbing speech and mechanical noise.

28 Claims, 4 Drawing Sheets

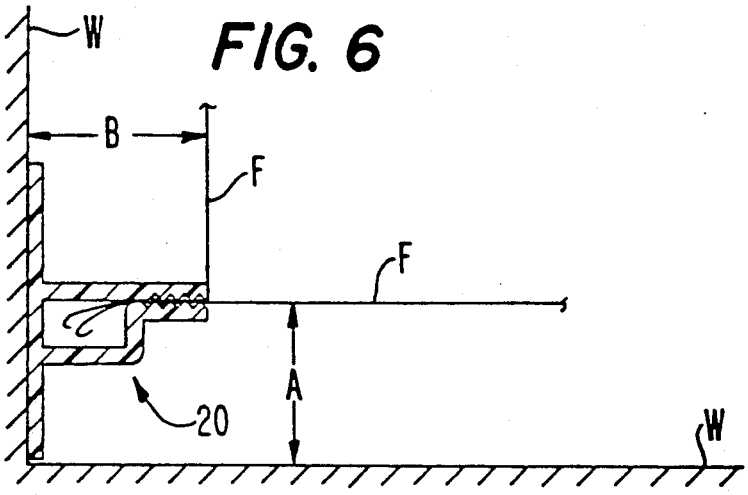
FIG. 6
FIG. 7
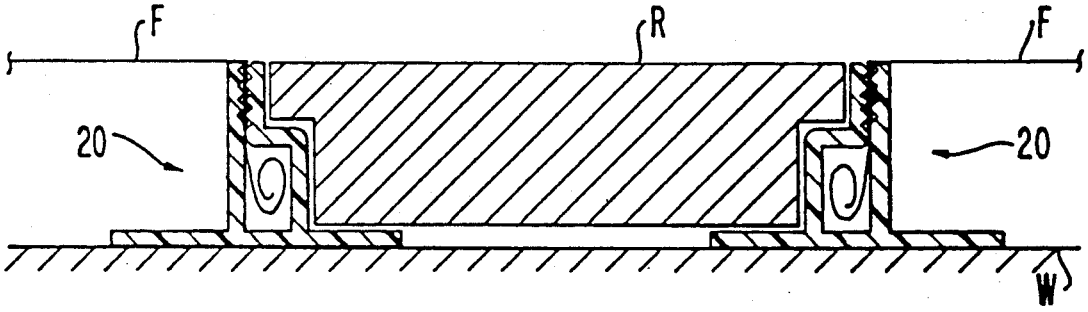
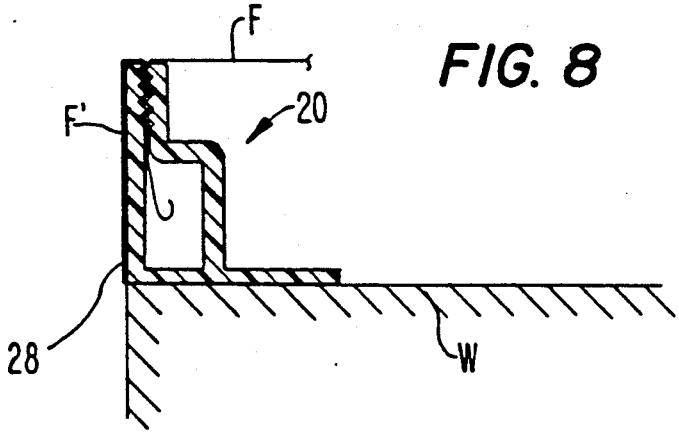
FIG. 8

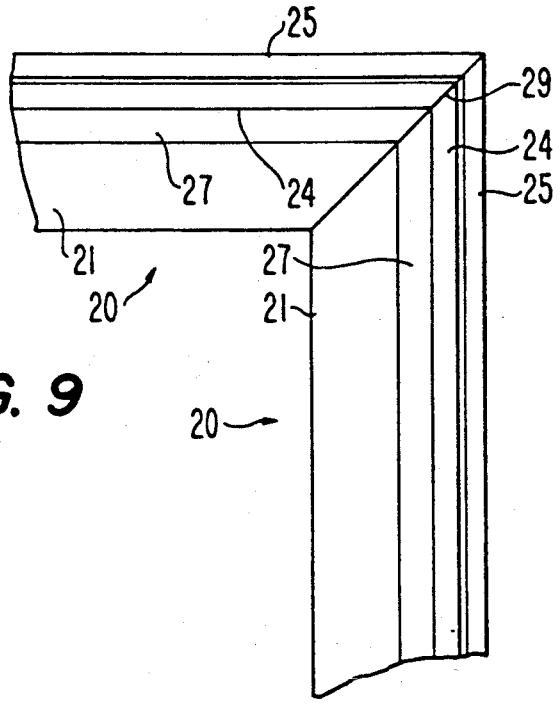
FIG. 9
FIG. 10
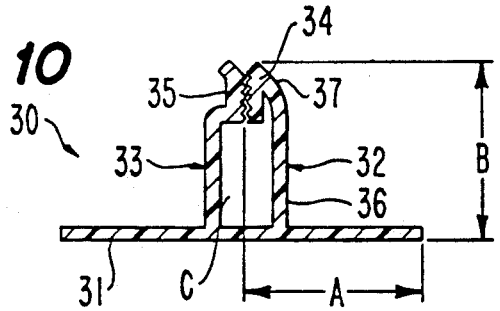
FIG. 11
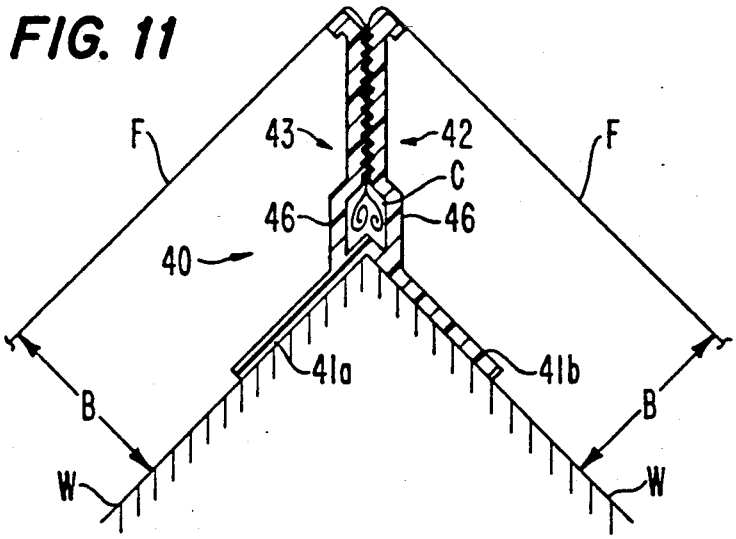

MOLDING STRIPS FOR MOUNTING A FLEXIBLE COVERING ONTO A SUPPORT SURFACE

This application is a continuation of now abandoned application No. 07/507,873 filed on Apr. 12, 1990.

BACKGROUND OF THE INVENTION (1) Field of the Invention

The present invention relates generally to extruded molding pieces attachable to a wall to form a frame assembly thereon for the purpose of supporting a fabric covering sheet.

(2) State of the Prior Art

A number of systems and apparatus for supporting a fabric sheet on a surface, such as a wall, are known. Generally, known systems provide a number of extruded pieces which together form a frame mounted on a wall. The fabric sheet to be mounted on the frame then has its edges securely supported by the frame assembly formed by the extruded pieces.

U.S. Pat. Nos. 4,631,882 and 4,788,806 to Sease disclose such systems wherein two separate pieces are used together to secure the fabric in place. U.S. Pat. No. 4,731,960, also to Sease, discloses another such extrusion wherein the edges of the fabric are simply held between gripping teeth formed on portions of an extruded piece. Small spaces are provided for storing the leftover edge of the fabric being supported.

U.S. Pat. Nos. 4,018,260, 4,053,008, 4,151,672 and 4,161,977, all to Baslow, are related to frame assemblies for mounting fabric sheets. Baslow uses extruded members which provide a storage space in the extruded member for fabric, along with gripping teeth, but require the use of a spline to sufficiently support the fabric being stretched on a particular frame assembly. The Baslow U.S. Pat. No. 4,161,977 simply uses gripper teeth and a small storage space in a solid member for supporting a fabric sheet. There also exist U.S. Pat. Nos. 4,197,686 and 4,625,490, both also to Baslow, which disclose the use of extruded pieces forming a storage space between walls of the extruded pieces. The fabric is tucked into the storage space formed by the extruded piece by the use of an appropriate stuffing tool.

FIG. 1 discloses a further known extrusion. The extrusion of FIG. 1 is used in frame assemblies for fabric wall coverings for the purpose of providing a mid-wall support inside a frame assembly. This extrusion, noting FIG. 1, comprises a base wall 1 having upstanding walls 2 and 3 extending therefrom. The walls 2 and 3 form a cavity or space therebetween for the insertion of fabric material. The walls neck together to form an inlet at 4, whereat is provided a number of gripping teeth for gripping a fabric inserted therein.

FIG. 2 shows another known extrusion, which extrusion is used for an "outside" wall corner. That is, when a fabric is desired to be brought around a corner of a wall, an extrusion such as seen in FIG. 2 is used. Base portions 11 and 12 are attached to their respective walls so that the extrusion will form a corner piece. Walls 13 and 14, extending from base portions 11 and 12, respectively, extend out the desired distance away from the corner of the walls. At the ends of the walls 13 and 14 is provided a gripping portion 15 with a cavity 16. The walls 13 and 14 neck together at portions 17, and then extend back towards the corner of the walls, forming grippers 15 and the cavity wall 16 thereat. This extrusion is thus one continuous piece.

The extrusion illustrated in FIG. 1 suffers generally from the drawbacks of insufficient size and strength, and an insufficiently sized cavity C for the amount of fabric which may be required to be stuffed into the cavity C. This renders the extrusion with little versatility and adaptability. In many of today's applications, patterns of a fabric to be secured to a wall have repeating vertical patterns, which repeat every so often in the horizontal direction. At the mid-wall seam portion, it is desirable to match the particular position of the pattern of one fabric with the particular position of the pattern of the other fabric adjacent thereto. To do this, one or the other fabric may require significant lateral adjustment. Thus, a substantially large cavity C may be required.

The outside corner extrusion as seen in FIG. 2 suffers from a similar drawback as discussed with FIG. 1, in that the cavity C provided in FIG. 2 may be much too small to accept all of the fabric that may be required to be stuffed thereinto. Furthermore, positioning of the extrusion of FIG. 2 on a corner tends to be unreliable, since, due to the manner of connection of base portion 11 and wall 14 with base portion 12 and wall 13, the two sides of the extrusion can easily pivot about the inlet portion of the extrusion. Thus, when such an extrusion is attempted to be placed on the corner, the installer is never quite sure whether or not the extrusion is properly positioned. If the base portions 11 and 12 are attached too close to the corner moreover, the gripping portion 15 will not be adequately tight.

SUMMARY OF THE INVENTION

It is a primary object of the present invention to provide an extrusion for a frame assembly for supporting a fabric covering on a wall or other substrate which is simpler, more reliable, and more versatile than the extrusions known in the prior art. More particularly, it is an object of the present invention to provide an extrusion which can be quickly and easily adapted to a variety of situations encountered by installers of such fabric wall coverings, rendering the installation thereof faster and simpler.

It is a secondary object of the present invention to provide an outside corner extrusion which is more versatile to use and is more securely positionable. More specifically, it is an object of the present invention to provide an outside corner extrusion which can be securely placed on a corner such that an assembler of a frame assembly can quickly and positively attach the outside corner extrusion. Furthermore, it is an object of the present invention to provide an outside corner extrusion which has a greater capacity for containing edges of fabric material inserted therein.

The primary object of the present invention is achieved by providing an extruded molding strip for use in a molding strip assembly which has an elongated base portion, first and second gripper walls extending therefrom, the first and second gripper walls having respective confronting portions thereon, and a gripping arrangement on at least one of the confronting portions for gripping a material when inserted therebetween. In particular, the present invention provides a molding strip such that the distance in a direction perpendicular to the base portion from the back side of the base portion to a distal end of the first gripper wall is substantially equal t the distance from a first side edge of the base portion to a line extending substantially centrally between the confronting portions of the gripper walls and perpendicularly to the base portion. By achieving the above described relationship, the molding strip of the present invention is easily and quickly attachable for the purpose of providing inside corners, without the necessity of measurements or cutting of the respective molding strips.

More specifically the present invention provides the elongated base portion, with this portion having a back side for abutment against the surface to which the base portion is to be attached, a front side and first and second side edges extending in the direction of elongation of the base portion. The first gripper wall extends substantially perpendicularly from the front side of the base portion. The second gripper wall also extends substantially perpendicularly from the front side of the base portion and substantially parallel to the first gripper wall at a position spaced from the first gripper wall such that a space is defined between the first and second gripper walls.

Preferably, the first and second gripper walls extend substantially the same distance in a direction perpendicular to the base portion. The overall height of the extrusion from the back side of the base portion to the distal ends of the gripper walls is, in one preferable embodiment, equal to one inch, and in another preferable embodiment equal to one-half inch. These one inch distances relate particularly well to fabric wall assemblies used as sound absorbers for the purpose of absorbing sound in certain critical frequency ranges of human hearing.

In one preferred embodiment, the first gripper wall has a main wall portion connected to and extending substantially perpendicularly from the base portion and a shoulder wall portion extending substantially perpendicularly from the first gripper wall portion toward the second gripper wall. The confronting portion of the first gripper wall extends substantially perpendicularly from the shoulder wall portion in a direction away from the base portion such that the confronting portion of the first gripper wall is parallel with and adjacent to the confronting portion of the second gripper wall. The second gripper wall defines the space between the walls together with the main wall portion and the shoulder wall portion. The first gripper wall is preferably at a position closer to the first side edge of the base portion than the second gripper wall. Furthermore, the gripping arrangement preferably comprises a plurality of gripper teeth, disposed on both the confronting portions of the gripper wall, so as to hold a material therebetween.

In a second preferred embodiment of the present invention, the first gripper wall comprises a main wall portion connected to and extending substantially perpendicularly from the base portion and a bevelled wall portion extending at an inclined angle generally toward the second gripper wall and away from the base portion. The confronting portion of the first gripper wall extends from the bevelled wall portion toward the base portion in a direction substantially perpendicular to the base portion such that the confronting portion of the first gripper wall is parallel with and adjacent the confronting portion of the second gripper wall. The second gripper wall defines the space between the gripper walls together with the main wall portion and the bevelled wall portion.

A preferred feature of the present invention is that the molding strip is provided as a unitary, one-piece structure. More preferably, the molding strip is made as an extrusion of a plastic material.

The secondary object of the present invention is achieved by the provision of a molding strip for use as an outside corner molding strip in a frame assembly, the molding strip having first and second substantially elongated base portions connected to each other, first and second gripper walls extending from respective base portions such that the gripper walls define therebetween a space for receiving material therein. The first and second gripper walls are connected to each other only by their respective base portions so as to leave sufficient space therebetween for a large quantity of fabric material. Furthermore, the first and second gripper walls have respective confronting portions confronting each other at respective ends thereof distant from their respective base portions. These confronting portions define an inlet end of the space for receiving material. The gripping arrangement is provided on at least one of the confronting portions for gripping a material when material is inserted between the confronting portions and the first gripper walls. The gripping arrangement is disposed at the inlet end such that a material must pass by the gripping arrangement before entering the space.

Furthermore, the space between the gripper walls of the outside corner molding strip extends all the way from the base portion to the gripping arrangement.

In a preferred feature of the present invention, the molding strip is preferably a unitary one-piece extrusion of a plastic material, the extrusion defining the base portions, the gripper walls, the confronting portions and the gripping arrangement. Furthermore, no other structure is necessary; the extrusion is complete and ready to use as is.

Furthermore, the gripper walls of the outside corner extrusion extend substantially at a 45° angle from their respective base portions, spaced from each other. Each gripper wall is made up of an angled portion and a main gripper wall portion. Each main gripper wall portion extends parallel to the other main gripper wall portion, and each angled portion extends from its respective main gripper wall portion toward the other angled portion. The confronting portions extend from their respective angle portions parallel and adjacent to each other. The gripping arrangement further comprises a plurality of gripping teeth disposed on both of the confronting portions.

Furthermore, the present invention provides a frame assembly for supporting a flexible material thereon, the frame assembly having a plurality of molding strips arranged so as to define a frame for the flexible material and for securing and supporting edge portions of the flexible material. The molding strips used with this frame assembly are provided in accordance with the above-described molding strips.

BRIEF DESCRIPTION OF THE DRAWINGS

Further objects, features and advantages of the present invention will be apparent to one of ordinary skill in the art from the below description when taken in conjunction with the accompanying drawings, wherein:

FIG. 6 is a cross-sectional view of one of the molding strips of FIGS. 4–5 used as an inside corner junction for a fabric wall covering;

FIG. 7 is a cross-sectional view of two molding strips according to FIGS. 4–5 used for separate fabric assemblies in conjunction with a reveal;

FIG. 8 is a cross-sectional view of a molding strip according to FIGS. 4–5 which has been modified in accordance with a further feature of the present invention;

FIG. 9 is a plan view of two molding strips according to FIGS. 4–5, the strips having been modified to form a corner frame junction;

FIG. 10 is an elevational cross-sectional view of a second embodiment of a molding strip according to the present invention; and FIG. 11 is a cross-sectional view of an outside corner molding strip according to the present invention.

DETAILED DESCRIPTION OF THE PREFERRED EMBODIMENTS

Molding strips according to the present invention are used in assembling frame assemblies for the purpose of securing and supporting large sheets of fabric on substrates such as walls. The fabrics form a panel on a wall or the like for purposes not only of decoration, but also for the purpose of absorbing sound in a room, concealment of tackpanel materials, and concealment of the other wall features as required.

Figure 3:
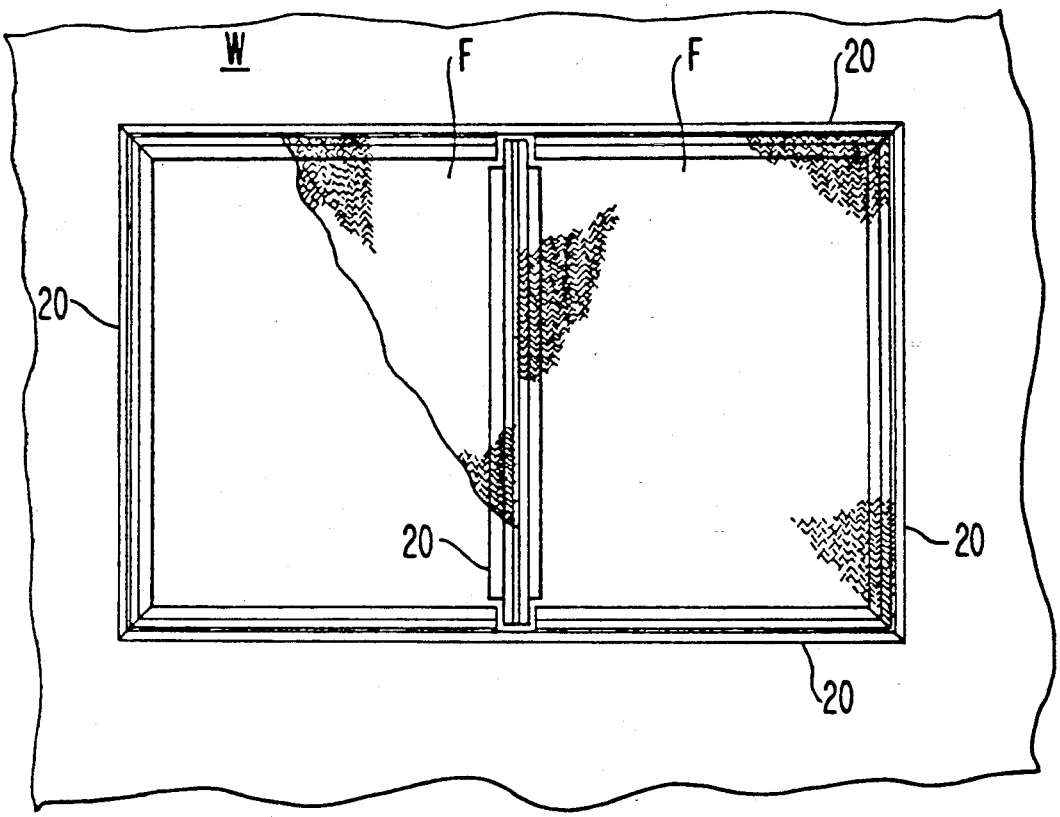
FIG. 3 is a perspective view of a frame assembly according to the present invention.

FIG. 3 illustrates how a fabric F is placed on a wall W. A number of molding strips 20, designed according to a first embodiment of the present invention, are attached to the wall W so as to form a frame defining the area desired to be covered by the fabric material F. As seen in the figure, four outside molding strips 20 may form a rectangular configuration, with a fifth molding strip 20 forming a midwall-seam portion. The fabric F is then stretched across the area defined by the frame assembly, and the edges thereof are held by the respective molding strips 20. One continuous fabric sheet F may be used, with a central portion thereof tucked into the mid-wall seam portion 20, or two separate fabric portions F could be used.

Note that an insulating material may be placed between the fabric F and the wall W within the area of the frame assembly. Such material will provide a backing for the fabric sheet F, as well as providing an insulating material for the purpose of absorbing sound in a room. Further note that the molding strips 20 may be attached to the wall W preferably by simply stapling the molding strips 20 to the wall, or by the use of any other suitable method. Further details of the manner of use of a frame assembly in accordance with the present invention will be discussed hereinbelow with reference to the specific embodiments of the molding strips.

Figure 4:
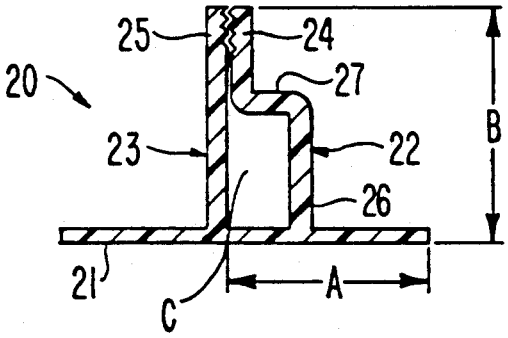
FIG. 4 is an elevational cross-sectional view of a first embodiment of a molding strip according to the present invention.
Figure 5:
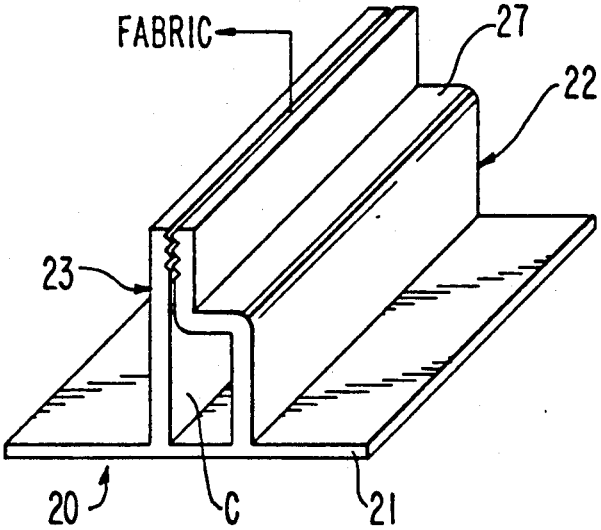
FIG. 5 is a perspective view of the molding strip according to FIG. 4.

FIGS. 4 and 5 show a cross-sectional view and a perspective view, respectively, of a molding strip 20 according to a first embodiment of the present invention. The molding strip 20 has a base portion 21. The base portion 21 is substantially flat and elongated, as seen in FIG. 5. A back side of the base portion 21 is placed against the wall or other surface to which the molding strip 20 is to be attached. The front side of the base portion 21 has two wall members 22 and 23 extending outwardly therefrom.

Preferably, the wall members 22 and 23 extend substantially perpendicularly to the base portion 21, but the angle of the wall members 22 and 23 relative to the base portion 21 may vary somewhat from the perpendicular without substantially affecting the nature and operation of the present invention. At their upper ends, as seen in FIG. 4, each wall 22 and 23 has a respective confronting portion 24 and 25. Connecting the confronting portion 24 of the wall member 22 to a main wall portion of wall member 22 is a shoulder portion 27. The main portion 26 and wall member 23 are spaced from each other so as to form a space or cavity C therebetween. The shoulder 27 serves to close off the cavity C, and the respective confronting portions 24 and 25 serve to define an inlet into the cavity C.

As can be seen in FIG. 5, wall members 22 and 23 extend parallel to first and second side edges of the base portion 21 in the longitudinal direction of the base portion 21, covering its entire extent. In addition, a gripping arrangement is provided between the confronting portions 24 and 25 for the purpose of gripping a fabric sheet or material inserted into the inlet defined between the confronting portions. In a preferred feature of the present invention, this gripping arrangement is a plurality of gripper teeth, preferably provided on both of the confronting portions. Furthermore, the height of the wall members 22 and 23, in the direction perpendicular to the base portion 21, is preferably the same.

Thus, when a fabric sheet or material F is secured to a molding strip, the fabric sheet or material is tucked into the inlet between confronting portions 24 and 25. This operation is usually carried out by overlaying the fabric on the inlet and using a thin elongated tool to push the fabric between the confronting portions 24 and 25 into the cavity C. The fabric material is then stored inside the cavity C. When a fabric material F has a particular pattern thereon, and several panels of the type illustrated in FIG. 3 are placed adjacent each other, it will be necessary to horizontally adjust a particular fabric material so that the patterns on adjacent sheets will match. For this purpose, the molding strips 20 making up the frame of a particular fabric sheet or material F must have a cavity C of a sufficiently large size so that the fabric sheet can be horizontally adjusted. That is, the cavity C must be large enough so that a fabric sheet F can be relatively freely adjusted in the horizontal direction without worrying about the cavity C not having space enough for all the material that may be required to be stuffed therein.

With regard to the molding strip 20 illustrated in FIGS. 4 and 5, the first side edge of the base portion 21, i.e. the edge adjacent the wall member 22, is generally intended to be placed toward the outside of a frame assembly, such that the fabric will extend from the molding strip 20 as illustrated in FIG. 5. However, such positioning is not critical. Indeed, the molding strip 20 of the present invention is intended be very versatile, and it can be used in a number of different positions, as will be explained below.

In a preferred feature of the present invention, and with reference to FIG. 4, the distance from a line passing between the confronting portions 24 and 25, whereat is provided the gripper arrangement, extending substantially perpendicularly to the base portion 21, to the first side edge of the base portion 21 is equal to the height of the wall member 22 in a direction substantially perpendicular to the base portion 21. In FIG. 4, these distances are represented by A and B, wherein A ≈ B. As noted above, the height of wall members 22 and 23 is preferably the same. Thus the distance B will also be the height of wall member 23, preferably.

The above-described relationship renders the molding strip 20 according to the present invention particularly advantageous to an installer of fabric material wall assemblies. Noting FIG. 6, there is illustrated one molding strip 20 which is used to form an inside corner junction. Two adjacent walls W each are to be provided with a frame assembly for securing a fabric thereto. By providing molding strip 20 at least on the one side thereof toward the first edge of the base portion 21 with a dimension equal to the height of the molding strip 20, the molding strip 20 can be put in position at the corner intersection of the walls W without requiring the installer to measure the correct distance away from the adjacent wall for the positioning of the molding strip 20. That is, the molding strip 20 is merely placed against a wall W with its first side edge substantially abutting the adjacent wall W, and the molding strip 20 is properly positioned with regard to the fabric height on both the walls W, whether a ½" or 1" fabric panel is desired, as seen in FIG. 6.

Noting FIG. 7, there is illustrated a particular advantage of the design of the molding strip 20 according to the first embodiment of the present invention. That is, two adjacent sheets of fabric material F may have a reveal R therebetween for making up the wall surface of fabric material. Shoulder portions 27 of the molding strip 20 are provided such that a reveal R can precisely fit into the space between the respective molding strips 20 as illustrated in FIG. 7. This feature also permits simplified inclusion of features such as chair railings, wood or metal trim strips, and grids into a wall surface.

Referring now to FIG. 8, there is illustrated a molding strip 20 wherein one side portion of the base portion 21 has been cut off at position 28. This is done to provide a single extension that can be worked in the field to create edge details. In FIG. 8, for example, a prewrap portion F' of a fabric sheet or material is pre-wrapped around the side of the molding strip 20 at which the edge of the molding strip 20 has been cut off in order to provide a particular fabric panel edge detail at an outside wall corner. The strip of pre-wrapped fabric material F' is adhesively applied to the molding strip before attaching the molding strip 20 in place.

The molding strip 20 as seen in FIG. 8 is also seen in FIG. 9. In FIG. 9 is should be noted that the molding strip 20 is provided with a mitered end so that two molding strips 20 may form a proper corner junction in a frame assembly. It should be clear to those of ordinary skill in the art that the molding strips of the present invention are designed so as to have maximum versatility, wherein an installer of frame assemblies can adapt the molding strips to almost any situation encountered, by either using various potential positions of the molding strips or by simply cutting away certain portions of the molding strips. The gauge of the extruded plastic material is selected to allow these modifications without compromising the strength of the parts.

From the above discussion, it could be seen that the molding strip 20 according to the first embodiment of the present invention is usable in a variety of different situations for different purposes and problems encountered by installers of frame assemblies for supporting fabric sheets or material. There is thus no need for a multiple extrusion inventory to be maintained by installers. The molding strip 20 can be used to provide the edge frames of a standard frame, as seen for example in FIG. 3, and can also be used as a mid-wall seam molding strip. Furthermore, the shoulder portions of the molding strips 20 enable a reveal R to be effectively and efficiently placed between two adjacent but non-abutting frame assemblies. A side edge of the molding strip 20 can also be sheared off to provide an edge or perimeter that is prewrapped with fabric to complete the panel.

A second embodiment according to the present invention is illustrated in FIG. 10. This embodiment has substantially the same advantages and features as the first embodiment of the present invention, but differs slightly in the manner of construction of the wall members of the molding strip. That is, in the embodiment as seen in FIG. 10, a first wall member 32 extends substantially perpendicularly from a base portion 31. A second wall member 33 also extends substantially perpendicularly from the base portion 31, spaced from the wall member 32. A bevelled or angled portion 37 is provided towards the end of the wall member 32. This angled portion 37 connects to a main portion 36 of the wall member 32. The angled or bevelled portion 37 is provided, basically, for decorative purposes, providing an outside edge of a fabric wall panel having a bevelled appearance. Confronting portions 34 and 35 form a gripping inlet to the cavity C of the molding strip 30. Additionally note that the same relationship established for molding strip 20 holds true for molding strip 30. That is, the measurement A of FIG. 10 is equal to the measurement B. In FIG. 11 is illustrated an outside corner molding strip according to the present invention. This molding strip has two base portions **41*a* and 41*b* for connection to respective walls W. The two base portions 41*a* and 41*b* are connected along one edge thereof to form a substantially right angle channel member. Wall members 42 and 43 extended substantially 45° from respective base portions 41*a* and 41*b*** parallel to each other. At their upper end, confronting portions have gripping arrangements thereon for forming a fabric inlet to a cavity C as seen in the figure.

By having the wall members extend substantially at 45 degrees from their respective base portions, the cavity C and the inlet associated therewith will extend symmetrically outwardly from the outside corner of the walls W to form a corner intersecting point for two separate sheets of fabric F. Furthermore, because the wall members are symmetrical, measurements B for each respective fabric sheet F will be the same.

Figure 1:
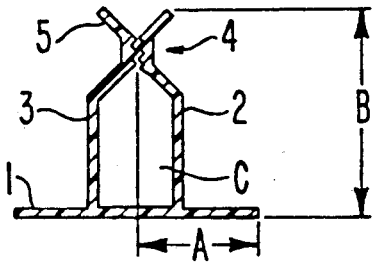
FIG. 1 (PRIOR ART)
FIG. 1 is a cross-section of a prior art molding strip extrusion.
Figure 2:
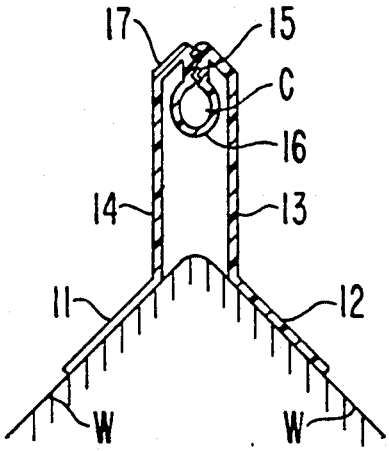
FIG. 2 (PRIOR ART)
FIG. 2 is a cross-sectional view of an outside corner molding strip known in the prior art.

The molding strip 40 of the present invention has the advantage over the prior art molding strip of FIG. 2 in that, by having the two base portions **41*a* and 41*b* securely connected to each other, an installer of a frame assembly will not have to worry whether or not the respective base portions are properly positioned on their respective walls W. The right angle corner made by the base portions 41*a* and 41*b* will securely place the molding strip 40 against the outside corner of the walls W with no guess work involved. Thus the base portions cannot be attached too close to the corner, and there will be no problem, in contrast with the prior art arrangement of FIG. 2, of the gripping portion being adequately tight. Furthermore, because the molding strip 40 is connected at its respective base portions 41*a* and 41*b*, the cavity C is defined by the entire space between the respective portions 46** of the wall members 42 and 43. In comparing FIG. 11 to FIG. 2, it can be seen that the connection at 16 in FIG. 2, connecting the two sides of the molding strip in FIG. 2, limits the size of the cavity C. But with the molding strip 40 according to the present invention, the cavity C could have a much larger size, because no connection corresponding to connection 16 is necessary. Thus the present invention provides a more reliable and easier to use molding strip, while at the same time increasing the available size of a cavity C for the fabric sheet or material F.

With respect to the above discussed molding strips 20 and 30, generally a nominal one inch height of the molding strips is desirable. This size of the molding strip, when used in forming frame assemblies for fabric panels, is particularly suitable for purposes of making panel assemblies that absorb sound frequencies in certain key frequencies of human hearing. That is, an absorber material of one inch thickness has substantial effectiveness in absorbing speech and mechanical noise at frequencies of 1,000 Hz and higher. 1,000 Hz roughly corresponds to the center frequency of human speech and hearing.

However, a standard one-half inch height of the molding strips may also be used, where sound absorption is less important. A half-inch height of the molding strips 20 and 30 still allows for a sufficiently sized cavity to allow easy alignment of horizontally repeating fabric patterns, i.e. a half inch sized molding strip in accordance with the present invention still provides a substantially large cavity C.

The molding strip 40, which may be used in combination with the molding strips 20 and 30, will have an appropriate suitable dimension in the direction B to correspond to the size of the respective molding strips 20 and 30 used therewith.

As can be seen from the above description of the present invention, the molding strips described herein are designed to be simple and easy for an installer to use. The profiles allow fully interchangeable use of a single extrusion for panel edges and midwall-seam applications. Furthermore, the molding strips are all designed so as to allow fast installation by an installer. Furthermore, molding strips according to this invention are adaptable to many different situations encountered by installers of fabric panel assemblies. Thus, in comparison with prior art arrangements, fewer different types of molding strips will be necessary for an installer to have available.

Although the present invention has been described and illustrated with respect to specific features thereof, it is to be understood that various modifications and changes may be made to the specifically described and illustrated features without departing from the scope of the present invention.

We claim:

1. A molding strip for use in molding strip assembly for supporting a flexible materials on a substrate, said molding strip comprising:

an elongated base portion having a back side for abutment against a surface to which said base portion is to be attached, a front side, and first and second side edges extending in the direction of elongation of said base portion;

a first gripper wall extending substantially perpendicularly from said front side of said base portion;

a second gripper wall extending substantially perpendicularly from said front side of said base portion and substantially parallel to said first gripper wall at a position spaced from said first gripper wall, said first and second walls defining a space therebetween;

wherein said front side of said elongated base portion has a front side portion outside of said space between said first and second walls;

said first and second gripper walls having respective confronting portions confronting each other; and a gripping arrangement on at least one of said confronting portions for gripping a sheet material when inserted between said first and second gripper walls;

wherein the distance in a direction perpendicular to said base portion from said back side of said base portion to the distal end of said first gripper wall is equal to the distance in a direction substantially parallel to said base portion from said first side edge to a line extending substantially centrally between said confronting portions of said first and second gripper walls and substantially perpendicular to said base portion, such that flexible materials along substrates forming an inside corner junction can be received in the space between the first and second gripper walls and gripped by the gripping arrangement at the inside corner junction spaced the same distance from their respective substrates.

2. The molding strip as set forth in claim 1, wherein:

said first and second gripper walls extend substantially the same distance in a direction perpendicular to said base portion.

3. The molding strip as set forth in claim 1, wherein:

said distance in a direction perpendicular to said base portion from said back side of said base portion to said distal end of said first gripper wall portion is substantially equal to one inch.

4. The molding strip as set forth in claim 1, wherein:

said distance in a direction perpendicular to said base portion from said back side of said base portion to said distal end of said first gripper wall portion is substantially equal to one-half inch.

5. The molding strip as set forth in claim 1, wherein:

said first gripper wall comprises a main wall portion connected to and extending substantially perpendicularly from said base portion and bevelled wall portion extending at an inclined angle generally toward said second gripper wall and away from said base portion, said confronting portion of said first gripper wall extending from said bevelled wall portion toward said base portion in a direction substantially perpendicular to said base portion such that said confronting portion of said first gripper wall is parallel with and adjacent said confronting portion of said second gripper wall and said bevelled wall portion defines said space together with said main wall portion and said second gripper wall.

6. The molding strip as set forth in claim 5, wherein:

said first gripper wall is closer to said first side edge of said base portion than said second gripper wall.

7. The molding strip as set forth in claim 5, wherein:

said gripping arrangement comprises a plurality of gripper teeth.

8. The molding strip as set forth in claim 7, wherein:

said gripper teeth are disposed on both said confronting portions for holding a material therebetween.

9. The molding strip as set forth in claim 1, wherein:

said base portion, said first and second gripper walls, said respective confronting portion and said gripping arrangement are unitary in a one-piece arrangement.

10. The molding strip as set forth in claim 9, wherein:

said one-piece arrangement is an extrusion of a plastic material.

11. The molding strip as set forth in claim 2, wherein said gripping arrangement is on both said confronting portions and comprises a plurality of teeth on both said confronting portions, said teeth of each respective said confronting portion being adjacent said teeth of the opposite said confronting portion such that said teeth of the respective said confronting portions can grip one or more flexible sheets therebetween.

12. A molding strip for use in a molding strip assembly, said molding strip comprising:

an elongated base portion having a back side for abutment against a surface to which said base portion is to be attached, a front side, and first and second side edges extending in the direction of elongation of said base portion;

a first gripper wall extending substantially perpendicularly from said front side of said base portion;

a second gripper wall extending substantially perpendicularly from said front side of said base portion and substantially parallel to said first gripper wall at a position spaced from said first gripper wall, said first and second gripper walls defining a space therebetween;

wherein said front side of said elongated base portion has a front side portion outside of said space between said first and second walls;

said first and second gripper walls having respective confronting portions confronting each other; and a gripping arrangement on at least one of said confronting portions for gripping a sheet material when inserted between said first and second gripper walls;

wherein the distance in a direction perpendicular to said base portion from said back side of said base portion to the distal end of said first gripper wall portion is substantially equal to the distance in a direction substantially parallel to said base portion from said first side edge to a line extending substantially centrally between said confronting portions of said first and second gripper walls and substantially perpendicular to said base portion; and wherein said first gripper wall comprises a main wall portion connected to and extending substantially perpendicularly from said base portion and a shoulder wall portion extending substantially perpendicularly from said first gripper wall portion toward said second gripper wall, said confronting portion of said first gripper wall extending substantially perpendicularly from said shoulder wall portion in a direction away from said base portion such that said confronting portion of said first gripper wall is parallel with and adjacent said confronting portion of said second gripper wall and said shoulder wall portion defines said space together with said main wall portion and said second gripper wall.

13. The molding strip as set forth in claim 12, wherein:

said first gripper wall is closer to said first side edge of said base portion than said second gripper wall.

14. The molding strip as set forth in claim 12, wherein:

said gripping arrangement comprises a plurality of gripper teeth.

15. The molding strip as set forth in claim 14, wherein:

said gripper teeth are disposed on both said confronting portions for holding a material therebetween.

16. A frame assembly for supporting flexible materials, said frame assembly comprising:

a plurality of molding strips arranged so as to define a frame for a flexible material for securing and supporting edge portions of the flexible material, each said molding strip comprising:

an elongated portion having a back side for abutment against a surface to which said base wall is to be attached, a front side, and first and second side edges extending in the direction of elongation of said base portion;

a first gripper wall extending substantially perpendicularly from said front side of said base portion;

a second gripper wall extending substantially perpendicularly from said front side of said base portion and substantially parallel to said first gripper wall at a position spaced from said first gripper wall, said first and second walls defining a space therebetween; and said first and second gripper walls having respective confronting portions confronting each other; and wherein said front side of said elongated base portion has a front side portion outside of said space between said first and second walls;

a gripping arrangement on at least one of said confronting portions for gripping a material when inserted between said first and second gripper walls;

wherein the distance in a direction perpendicular to said base portion from said back side of said base portion to the distal end of said first gripper wall is equal to the distance in a direction substantially parallel to said base portion from said first side edge to a line extending substantially centrally between said confronting portions of said first and second gripper walls and substantially perpendicular to said base portion, such that flexible materials along surfaces forming an inside corner junction can be received in the space between said gripper walls and gripped by said gripping arrangement at the inside corner junction spaced the same distance from their respective surfaces.

17. The frame assembly as set forth in claim 16, wherein for each said molding strip:

said first and second gripper walls extend substantially the same distance in a direction perpendicular to said base portion.

18. The frame assembly as set forth in claim 16, wherein for each said molding strip:

said first gripper wall comprises a main wall portion connected to and extending substantially perpendicularly from said base portion and a bevelled wall portion extending at an inclined angle generally toward said second gripper wall and away from said base portion, said confronting portion of said first gripper wall extending from said bevelled wall portion toward said base portion in a direction substantially perpendicular to said base portion such that said confronting portion of said first gripper wall is parallel with and adjacent said confronting portion of said second gripper wall and said bevelled wall portion defines said space together with said main wall portion and said second gripper wall.

19. The frame assembly as set forth in claim 18, wherein for each said molding strip:

said first gripper wall is closer to said first side edge of said base portion than said second gripper wall.

20. The frame assembly as set forth in claim 18, wherein for each said molding strip:

said gripper arrangement comprises a plurality of gripper teeth.

21. The frame assembly as set forth in claim 20, wherein for each said molding strip:

said gripper teeth are disposed on both said confronting portions for holding a material therebetween.

22. The frame assembly as set forth in claim 16, wherein for each said molding strip:

said base portion, said first and second gripper walls, said respective confronting portion and said gripping arrangement are unitary in a one-piece arrangement.

23. The frame assembly as set forth in claim 22, wherein for each said molding strip:

said one-piece arrangement is an extrusion of a plastic material.

24. A frame assembly for supporting a flexible material, said frame assembly comprising:

a plurality of molding strips arranged so as to define a frame for a flexible material for securing and supporting edge portions of the flexible material, each said molding strip comprising:

an elongated portion having a back side for abutment against a surface to which said base wall is to be attached, a front side, and first and second side edges extending in the direction of elongation of said base portion;

a first gripper wall extending substantially perpendicularly from said front side of said base portion;

a second gripper wall extending substantially perpendicularly from said front side of said base portion and substantially parallel to said first gripper wall at a position spaced from said first gripper wall, said first and second gripper walls defining a space therebetween; and said first and second gripper walls having respective confronting portions confronting each other; and wherein said front side of said elongated base portion has a front side portion outside of said space between said first and second walls;

a gripping arrangement on at least one of said confronting portions for gripping a material when inserted between said first and second gripper walls;

wherein the distance in a direction perpendicular to said base portion from said back side of said base portion to the distal end of said first gripper wall is substantially equal to the distance in a direction substantially parallel to said base portion from said first side edge to a line extending substantially centrally between said confronting portions of said first and second gripper walls and substantially perpendicular to said base portion; and wherein said first gripper wall comprises a main wall portion connected to and extending substantially perpendicularly from said base portion and a shoulder wall portion extending substantially perpendicularly from said main wall portion toward said second gripper wall, said confronting portion of said first gripper wall extending substantially perpendicularly from said shoulder wall portion in a direction away from said base portion such that said confronting portion of said first gripper wall is parallel with and adjacent said confronting portion of said second gripper wall and said shoulder wall portion defines said space together with said main wall portion and said second gripper wall.

25. The frame assembly as set forth in claim 24, wherein for each said molding strip:

said first gripper wall is closer to said first side edge of said base portion than said second gripper wall.

26. The frame assembly as set forth in claim 24, wherein for each said molding strip:

said gripping arrangement comprises a plurality of gripper teeth.

27. The frame assembly as set forth in claim 26, wherein for each said molding strip:

said gripper teeth are disposed on both said confronting portions for holding a material therebetween.

28. A molding strip for use in a molding strip assembly for supporting a flexible material, said molding strip being useable as an inside corner junction of flexible materials, and comprising:

an elongated base portion having a back side for abutment against a surface to which said base portion is to be attached, a front side, a first and second side edges extending in the direction of elongation of said base portion;

a first gripper wall extending substantially perpendicularly from said front side of said base portion;

a second gripper wall extending substantially perpendicularly from said front side and said base portion and substantially parallel to said first gripper wall at a position spaced from said first gripper wall, said first and second walls defining a space therebetween;

wherein said front side of said elongated base portion has a front side portion outside of said space between said first and second walls;

said first and second gripper walls having respective confronting portions confronting each other;

a gripping arrangement on a least one of said confronting portions for gripping a sheet material when inserted between said first and second gripper walls; and spacing means for receiving flexible materials at an inside corner junction of two walls such that the flexible materials are substantially equidistantly spaced from their respective walls, said spacing means comprising said base portion having a dimension, in a direction perpendicular to the longitudinal extent thereof, from said first side edge to a line extending substantially centrally between said gripper walls and substantially perpendicular to said base portion, which is equal to the distance, in a direction perpendicular to said base portion, from said back side of said base portion to the distal end of said first gripper wall.

* * * * *